US009689056B2

(12) United States Patent
Dudley

(10) Patent No.: US 9,689,056 B2
(45) Date of Patent: Jun. 27, 2017

(54) SOLVENT EXTRACTION PROCESS

(71) Applicant: BHP Billiton Olympic Dam Pty Ltd, Melbourne, Victoria (AU)

(72) Inventor: Kym Anthony Dudley, Clare (AU)

(73) Assignee: BHP BILLITON OLYMPIC DAM CORPORATION PTY LTD, Melbourne, Victoria (AU)

( * ) Notice: Subject to any disclaimer, the term of this patent is extended or adjusted under 35 U.S.C. 154(b) by 58 days.

(21) Appl. No.: 14/427,017

(22) PCT Filed: Sep. 13, 2013

(86) PCT No.: PCT/AU2013/001047

§ 371 (c)(1),
(2) Date: Mar. 10, 2015

(87) PCT Pub. No.: WO2014/040136

PCT Pub. Date: Mar. 20, 2014

(65) Prior Publication Data

US 2015/0240330 A1 Aug. 27, 2015

(30) Foreign Application Priority Data

Sep. 13, 2012 (AU) ..... 2012904000

(51) Int. Cl.
*C22B 60/02* (2006.01)

(52) U.S. Cl.
CPC ..... *C22B 60/026* (2013.01)

(58) Field of Classification Search
None
See application file for complete search history.

(56) References Cited

U.S. PATENT DOCUMENTS 6,645,453 B2 11/2003 Singh et al.
2012/0297929 A1 11/2012 Nyman

FOREIGN PATENT DOCUMENTS

WO WO 2011/095679 8/2011

OTHER PUBLICATIONS

Quinn et al., Solvent extraction of uranium from saline leach liquors using DEHPA/Alamine 336 mixed reagent, Hydrometallurgy, 134-135 (Feb. 2013).*
PCT/AU2013/001014 International Search Report dated Oct. 14, 2013 (5 pages including English translation).

* cited by examiner

*Primary Examiner* — Melissa Swain
(74) *Attorney, Agent, or Firm* — Brinks Gilson & Lione; G. Peter Nichols

(57) ABSTRACT

A process for extracting uranium from an acidic uranium, chloride, iron and sulphate containing solution, including the steps: a. contacting the solution with an organic phase containing a trialkylphosphine oxide to form a uranium loaded organic phase; b. scrubbing the uranium loaded organic phase to remove any impurities and form a scrubbed organic phase; c. stripping the scrubbed organic phase with an acidic sulphate solution to produce an aqueous uranium strip solution; and precipitating a uranium product from the aqueous uranium strip solution.

18 Claims, 5 Drawing Sheets

SOLVENT EXTRACTION PROCESS

This application claims priority to International Application No. PCT/AU2013/001047 filed Sep. 13, 2013; and Australian Application No. 2012904000 filed Sep. 13, 2012, the entire contents of each are incorporated herein by reference.

TECHNICAL FIELD

A solvent extraction process for the extraction of a target metal from a chloride containing solution is disclosed. The process may be used for the extraction of uranium from an acidic saline pregnant leach solution, particularly one containing high iron and sulphate levels.

BACKGROUND ART

The minerals sector has been under increased pressure in recent times to minimize water consumption. Many mining operations are located in remote, dry areas, where water is scarce. Accordingly, water conservation can be critical to ensure the viable operation of a mine and typically entails use of groundwater and/or recycled water in process operations. Other mines may be located near the coast where seawater may be used as the process water. As a consequence, process waters will usually inherently contain dissolved salts, which can vary from mine to mine and even over the course of a single mine operation. In some locations, the process waters can be highly saline, such as in excess of 100 g/L.

Process waters having high or variable salinity can be problematical in downstream operations, particularly during the extraction of target metals by solvent extraction or ion exchange. This can be due to lack of selectivity for the target metals over chloride ions and other dissolved impurities (such as ferric ions). Without wishing to be limited by theory, it may be that the metal chloride complexes are more problematic to separate effectively, compared to their sulphate counterparts. In the case of solvent extraction, chloride and other impurities may load into the organic phase together with the target metal, either as an elemental ion or as chloride complexes, requiring their subsequent removal. In extreme cases the chloride and other impurities can preclude or retard the uranium loading. Moreover if the salinity of the pregnant leach solution varies over the course of a leaching operation, the details of the extraction process may need to also vary in response.

There is accordingly a need for a process for recovering uranium from chloride containing process waters which overcomes, or at least alleviates, one or more disadvantages of the prior art. There is also a need for an effective process for recovering uranium from chloride containing process waters which also contain high iron and sulphate levels.

There is further a need for such a process which can be easily modified/adapted to accommodate variations in the chemistry of process waters either between plants or within a particular plant over time. An example is where the salinity of the process waters within a plant increases over the course of an operation due to process stream/water recycling, increasing salinity of the groundwater or the inclusion of an alternative more saline source of water such as sea or bore water.

The above references to the background art do not constitute an admission that the art forms a part of the common general knowledge of a person of ordinary skill in the art.

The above references are also not intended to limit the application of the process as disclosed herein.

SUMMARY OF THE DISCLOSURE

In a first aspect there is disclosed a process for extracting uranium from an acidic uranium, chloride, iron and sulphate containing solution, including the steps:

a. contacting the solution with an organic phase containing a trialkylphosphine oxide to form a uranium loaded organic phase;
b. scrubbing the uranium loaded organic phase to remove any impurities and form a scrubbed organic phase;
c. stripping the scrubbed organic phase with a sulphate solution to produce an aqueous uranium strip solution; and
d. precipitating a uranium product from the aqueous uranium strip solution.

The acidic uranium, chloride, iron and sulphate containing solution may be a pregnant leach solution (PLS), such as one formed from the acidic leaching of a uranium containing ore or ore concentrate. It may instead or additionally be an upgraded uranium containing solution such as an eluate from a preceding ion exchange process (e.g. an Eluex process) or a strip solution from a preceding solvent extraction process.

Phosphine oxides, such as trialkylphosphine oxides (TAPO), have been found to be good extractants for uranium. However, their selectivity for uranium can be low, resulting in a number of impurities, such as chloride, iron and/or zirconium, being also extracted with uranium. The inclusion of a scrubbing step enables reduction or removal of the co-extracted impurities, thereby minimizing impurities in the stripped aqueous solution.

The TAPO may be a trioctylphosphine oxide. In one embodiment, the TAPO may be a tridecylphosphineoxide. In another embodiment the TAPO may be a tributylphosphine oxide.

In an embodiment, the extractant may be a blend of two or more phosphine oxides. An example of such an extractant is the reagent available under the tradename CYANEX® 923 which contains several trialkylphosphine oxides, including mainly normal hexyl and octyl groups.

The organic phase may additionally include a substituted amine or its salt (hereinafter collectively referred to as substituted amine (salt)). The substituted amine (salt) may be a tertiary amine or quaternary amine salt. An example of a suitable tertiary amine is tri (C8-C10) amine commercially available as Alamine®336. An example of a quaternary amine salt is tri-(C8-C18) ammonium chloride commercially available as Alaquat®336.

The concentration of chloride in the acidic uranium, chloride, iron and sulphate containing solution may be as high as 100 g/l, or higher. However, in most embodiments, the chloride concentration is a minimum of 5 gpl.

The concentration of iron in the acidic uranium, chloride, iron and sulphate containing solution may be as high as 50 g/l, or higher. However, in most embodiments, the iron concentration is a minimum of 1 g/l, such as a minimum of 5 g/l. The iron may be present partly or wholly as iron(III). The iron chemistry does not need to be modified (such as by reducing ferric to ferrous) prior to extraction, contrary to previous extraction processes which use organic phases that preferentially extract iron(III)— such as DEHPA (di(2-ethylhexyl) phosphoric acid).

The following discussion focuses on the use of one or more TAPOs as phosphine oxides in the organic phase.

The relative amounts of TAPO and substituted amine (salt) may be varied depending on the physicochemical properties of the pregnant leach solution. In particular, the ratio of TAPO to substituted amine (salt) may be varied according to the level of impurities in, in particular the salinity of, the pregnant leach solution. At low chloride concentrations, such as below about 10 g/L, preferably below around 5 g/L, extraction of uranium is favoured by using a solvent having no or a relatively low amount of TAPO. As chloride level increases, the ratio of TAPO to substituted amine (salt) preferably also increases. At chloride concentrations above 5 g/l, the molar ratio of substituted amine (salt) to TAPO in the solvent may be a minimum of 90:10, preferably at least 70:30. At chloride concentrations above about 10, preferably above 15 g/L, more preferably above 20 g/L, extraction of uranium is favoured by using a solvent having a ratio of at least 50:50. In some embodiments, the solvent may have no or a relatively low amount of substituted amine (salt), for example, the solvent may have a ratio of substituted amine (salt) to TAPO of at least 30:70, such as at least 10:90. In some embodiments, as chloride concentration exceeds 20 g/l, the solvent may contain 100% TAPO (i.e., the solvent may contain no substituted amine (salt).

In order to remove the impurities from the loaded organic phase, it is scrubbed with a suitable aqueous solution. The scrubbing solution may be a sulfate based solution, such as a sulfuric acid based aqueous solution. The scrubbing solution may also include an amount of the target metal of the solvent extraction process, in this case uranium, to assist with the scrubbing process. The acid concentration may vary from 0.1M-1.0M. In some embodiments, the acid concentration was at least 0.5M. The scrubbing step preferably results in the substantial removal of chloride. It also may result in the substantial removal of dissolved ionic species, such as ferric and other ions. Adjustment of the pH of the scrub solution may be required in order to assist with the scrubbing process.

The scrubbed organic is then stripped using an acidic sulfate solution in order to produce an aqueous uranium strip solution. The sulfate solution may be a concentrated sulfate solution. The concentration of sulfate may be greater than 1M. The concentration of sulfate may be up to 4M. In order to achieve a concentrated sulfate solution, the stripping solution may be formed by dissolution of a highly soluble sulfate salt. In an embodiment, the stripping solution is an ammonium sulfate solution. In another embodiment, the stripping solution is a sodium sulfate solution. It has been found that ammonium sulfate solution is more effective than sodium sulfate as a stripping solution due to its greater solubility and therefore higher concentration of sulfate formed from its dissolution. The concentration of ammonium sulfate may up to saturation (eg up to 3.7 M). In an embodiment, the ammonium sulfate concentration may be at least 2 M, such as at least 3 M. The pH of the stripping solution may be less than 5. The pH may be controlled to between 2 and 5.

The stripping step may be followed by a washing step. The washing step may comprise treating the aqueous uranium strip solution with an acidic wash solution. The acidic wash solution may comprise a sulphuric acid solution. The sulphuric acid solution may have a concentration of 0.1M-1.0M. In some embodiments, the acid concentration was at least 0.5M.

The (optionally washed) aqueous uranium strip solution is treated to precipitate a uranium product from it. The uranium product may be a diuranate, such as an ammonium diuranate (ADU) or sodium diuranate (SDU), depending on the stripping solution employed. Precipitation is effected using conventional methods, such as by an increase in pH of the aqueous strip solution by addition of ammonia to effect precipitation of ammonium diuranate. Precipitation from a sulphate solution can also be undertaken using hydrogen peroxide.

The process may be conducted over a moderate temperature range. For example, the process may be conducted at a temperature up to 50° C. In an embodiment, the process may be conducted at a temperature in the range from 10° C. to 50° C. The contacting and scrubbing steps may be conducted at ambient temperature. The temperature of the stripping step may be conducted at a slightly elevated temperature, such as at a minimum of 30° C. In an embodiment, the temperature may be up to 40° C.

The operation at moderate temperatures reduces energy consumption and avoids the need for specialist high temperature equipment.

The process may be conducted at atmospheric pressure, thereby avoiding the need for high pressure equipment.

In an embodiment, the process is continuous. The process may be conducted in a counter current operation. In an embodiment of the counter current operation, pregnant leach solution formed from acid leaching of uranium ore concentrate is treated in multiple solvent extraction stages with an organic phase containing a trialkylphosphine oxide. The PLS from the leach circuit enters the first extraction stage and proceeds through the extraction stages in series. After extraction, the barren solution is recycled back to the leach circuit as raffinate. The stripped organic phase, enters the last extraction stage and proceeds through the extraction stages in counter current flow to the PLS and exits the first extraction stage as a loaded organic phase.

The loaded organic phase then enters the first scrub stage and proceeds through the scrub stages in series to exit the final scrub stage as a scrubbed organic phase. The fresh aqueous scrub solution enters the final scrub stage and flows counter currently to the organic phase and exits the first scrub stage as spent scrub solution.

The scrubbed organic phase then enters the first strip stage and proceeds in series through the strip stages to exit as stripped organic from the last strip stage. The barren aqueous strip solution from the uranium precipitation process enters the last strip stage and flows counter currently to the organic phase and exits the first strip stage as loaded strip solution to go back to the precipitation process area.

The stripped organic phase may be subjected to a conditioning step prior to being recycled to the extraction stage. This conditioning step may be an additional scrubbing process to remove or dilute entrained strip solution from the stripped organic phase. It may also be a chemical adjustment of the stripped organic phase, such as re-protonating the substituted amine salt component of the organic phase.

In a second aspect there is disclosed a process for extracting uranium from an acidic saline uranium solution, including the steps:

a. contacting the solution with an organic phase containing a trialkylphosphine oxide to form a uranium loaded organic phase;
b. scrubbing the uranium loaded organic phase to remove any impurities and form a scrubbed organic phase;
c. stripping the scrubbed organic phase with a sulphate solution to produce an aqueous uranium strip solution; and
d. precipitating a uranium product from the aqueous uranium strip solution.

In a third aspect there is provided a process for extracting uranium from a saline uranium containing solution, including the step of contacting the solution with an organic phase containing a trialkylphosphine oxide (TAPO) and a substituted amine (salt), the organic phase having a ratio of the TAPO to the substituted amine or substituted amine salt which is determined by the chloride concentration in the saline uranium containing solution.

TAPO may be the sole or the predominant organic extractant in the solvent mixture.

At chloride concentrations above 5 g/l, the molar ratio of substituted amine (salt) to TAPO in the solvent may be a minimum of 90:10, such as at least 70:30. At chloride concentrations above about 15 g/L, preferably above 20 g/L, extraction of uranium is favoured by using a solvent having a ratio of at least 50:50. In some embodiments, the solvent may have no or a relatively low amount of substituted amine (salt), for example, the solvent may have a ratio of substituted amine (salt) to TAPO of at least 30:70, such as at least 10:90. In some embodiments, as chloride concentration exceeds 20 g/l, the solvent may contain 100% TAPO (i.e., the solvent may contain no substituted amine (salt)).

BRIEF DESCRIPTION OF THE DRAWINGS

Notwithstanding any other forms which may fall within the scope of the process set forth in the Summary, specific embodiments will now be described, by way of example only, with reference to the accompanying drawings in which.

DETAILED DESCRIPTION OF SPECIFIC EMBODIMENTS

Figure 1:
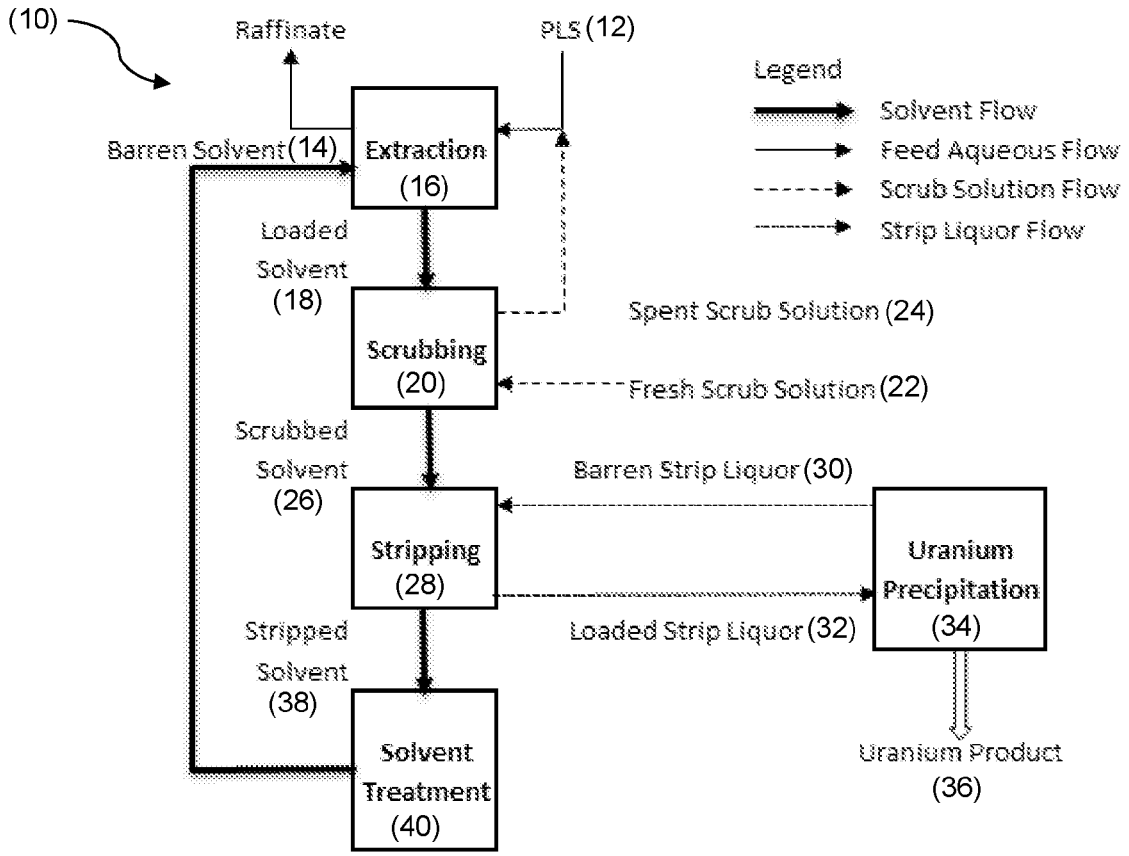
FIG. 1 is a flowsheet illustrating a process embodiment. Note, we have used the term solvent in place of organic in this diagram.

Referring firstly to FIG. 1, a flow sheet, 10, illustrates a first embodiment of the disclosed solvent extraction process. Pregnant leach solution (PLS), 12, which contains dissolved uranium and impurities comprising dissolved chloride and iron, is contacted with an organic phase (solvent) containing TOPO or TOPO/Alamine, 14, in an extraction stage 16. The loaded solvent, 18, is then passed to a scrubbing stage, 20, where a sulfate based scrub solution, 22 such as sulfuric acid, is contacted with the loaded solvent 18 and substantially removes chloride and iron ions therefrom. It is thought that the impurity ions are less strongly extracted/solvated than uranium by the organic phase and therefore can be removed with moderate aqueous conditions as compared to uranium. The spent scrub solution, 24, is recycled to the PLS stream, 12. The scrubbed solvent, 26, then passes to a stripping stage, 28, where it is contacted with a strip liquor, 30, comprising an ammonium sulfate solution.

Uranium loads into the strip liquor and the loaded strip liquor, 32, is transferred to the uranium precipitation stage, 34. Precipitation occurs by an increase in pH of the aqueous strip solution by addition of ammonia to achieve a pH of ~7 and a uranium product, 36, comprising ammonium diuranate is produced. The stripped solvent, 38, is subjected to a conventional solvent treatment step, 40, in which the solvent is washed to remove entrained sulphates (from residual strip liquor) and the 'acidity' of the solvent is adjusted (i.e. it is re-protonated if a tertiary amine is present) and the treated barren solvent is returned to the extraction stage, 16.

Figure 2:
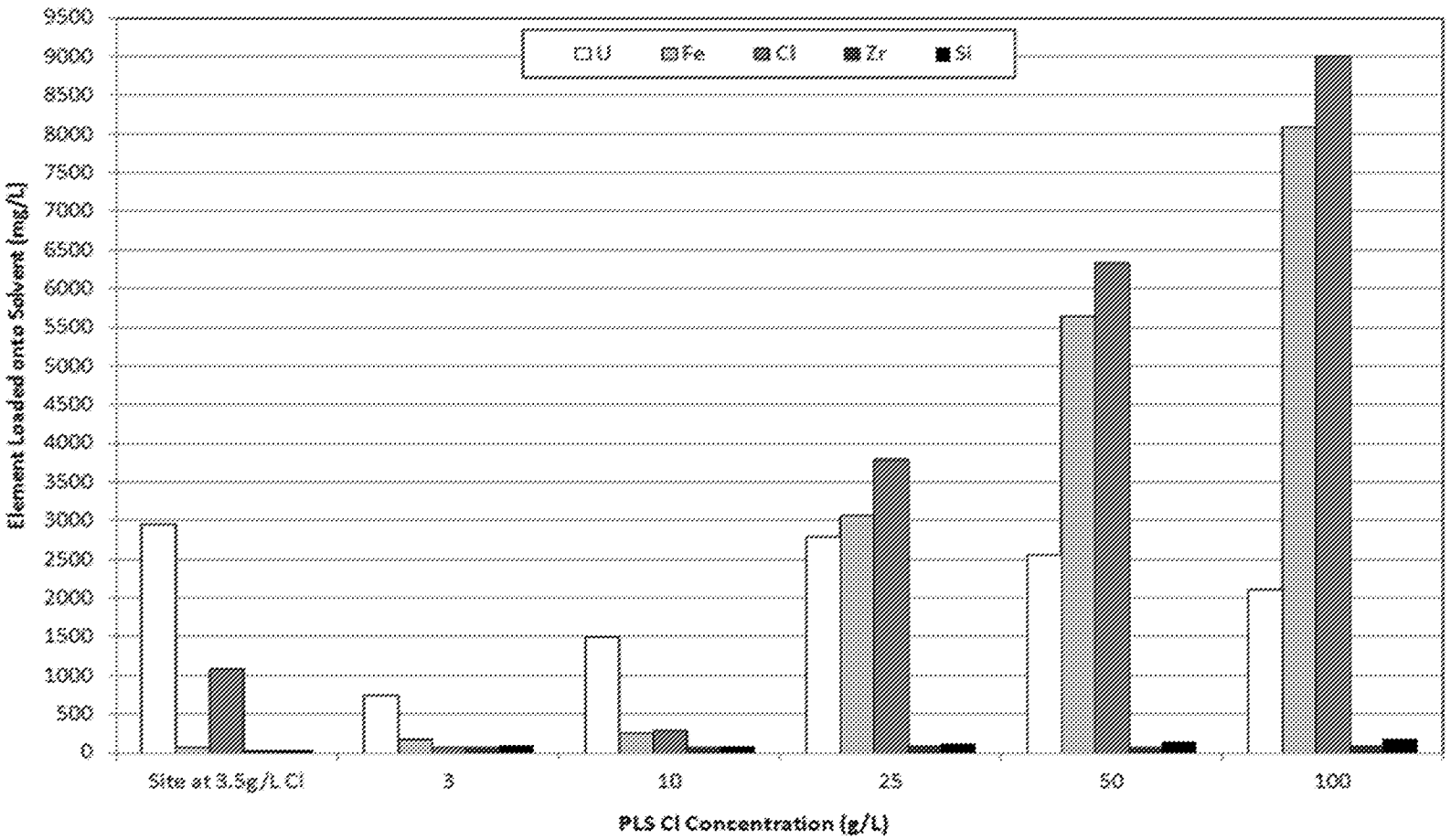
FIG. 2 is a graph showing the concentrations of various elements loaded onto a TOPO containing solvent at varying chloride concentrations.

Referring now to FIG. 2, a graph shows the results of a solvent extraction process of the first aspect of the disclosure conducted on a uranium containing PLS which also contains various impurities. The concentrations of uranium, iron, chloride, zirconium and silicon loaded onto a TOPO containing solvent are plotted against varying chloride concentrations. Also shown for comparison are the respective loadings using a conventional tertiary amine extraction process ("Site at 3.5 g/L Cl"). The conventional process was conducted using a PLS having a chloride concentration of 3.5 g/L and an extractant comprising a tertiary amine (Alamine 336) dissolved in a conventional solvent extraction diluent (i.e. Shellsol™ kerosene). The results are shown in the bottom left hand corner of the graph where the concentrations of uranium, iron, chloride, zirconium and silicon loaded onto the solvent are represented by the bars from left to right, respectively. The remaining groups of bars show the loadings of the elements from a PLS having chloride concentrations of (from left to right) 3, 10, 25, 50 and 100 g/L, when contacted with 0.2 M TOPO (Cyanex 921) in kerosene at an aqueous to organic ratio of 10:1.

The results demonstrate that U extraction occurred with 0.2M TOPO over the range tested (3 to 100 g/L). A similar level of uranium extraction from a PLS containing 25 gpl Cl was achieved using TOPO as compared to the conventional process at a chloride concentration of 3.5 gpl. Peak performance occurred between 25 to 50 g/L chloride. It is also evident from a comparison of the results at increasing chloride concentration that there is a relationship between Cl concentration and uranium uptake and selectivity when TOPO is used as the extractant: uranium selectivity decreased with increasing chloride concentration.

Figure 3:
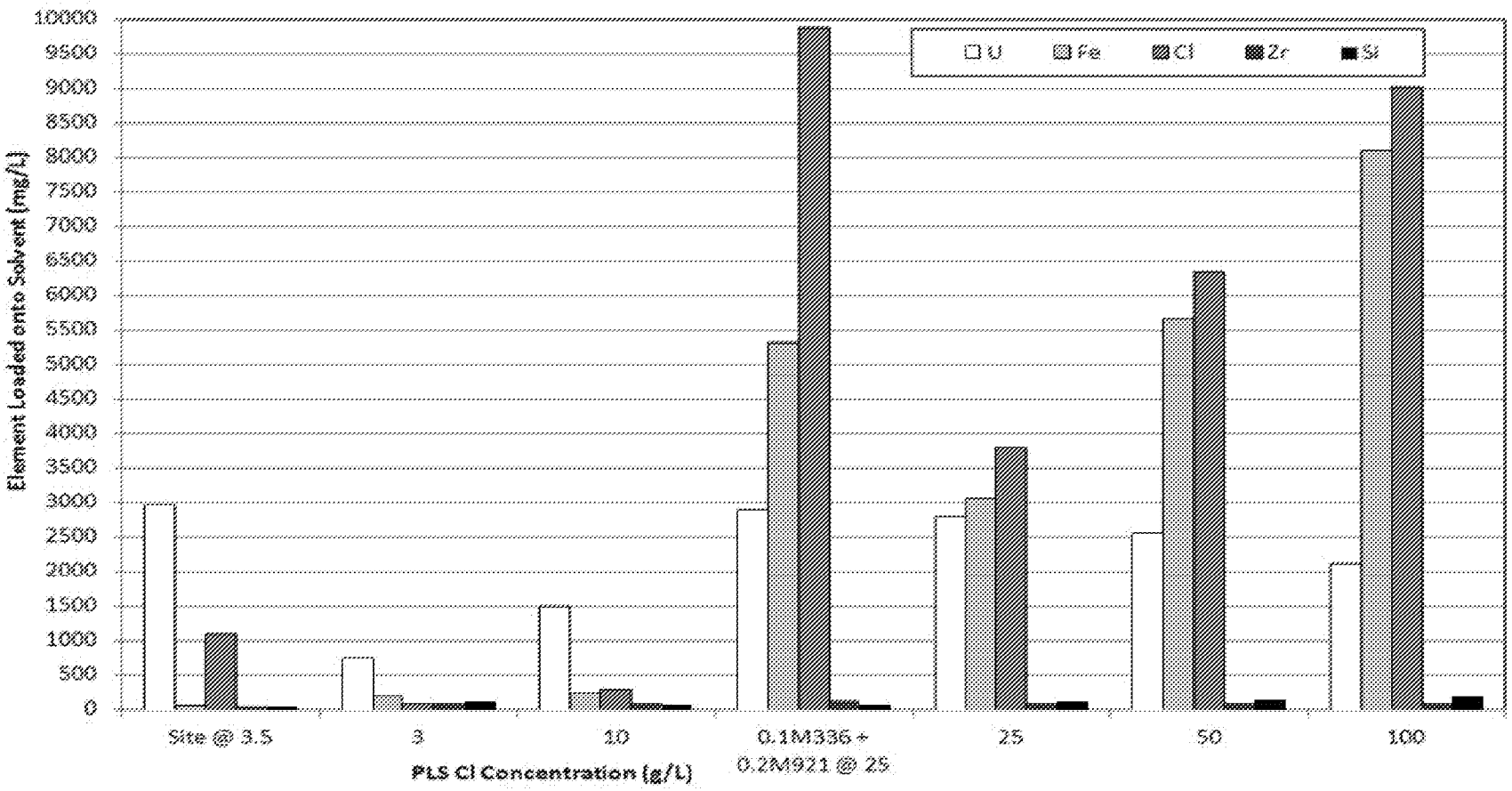
FIG. 3 is a graph showing the concentrations of various elements loaded onto organic solvent containing TOPO or a blend of TOPO and tertiary amine at varying chloride concentrations.

Referring now to FIG. 3, this graph compares the selectivity for uranium when the PLS is contacted with kerosene containing either TOPO or a TOPO/tertiary amine blend. The middle group of bars shows (from left to right, respectively) the concentrations of uranium, iron, chloride, zirconium and silicon loaded onto the solvent when the PLS (containing 25 g/L chloride) is contacted with TOPO/tertiary amine blend (0.1 M Alamine 336 and 0.2M Cyanex 921). The group of bars to the right thereof shows the equivalent results when extraction is performed using TOPO alone. It is evident that the level of selectivity for uranium over iron and chloride is significantly lower using a TOPO/Tertiary amine blend than using TOPO alone at that particular chloride concentration. Consequently, stripping of TOPO is expected to be simplified compared to the TOPO/tertiary amine blend.

The results suggest that at relatively lower chloride concentrations, uranium extraction is favoured using a solvent predominantly, or solely, comprising tertiary amine whereas at higher concentrations extraction of, and selectivity for, uranium is favoured using a solvent predominantly, or solely, comprising TOPO.

At intermediate chloride concentrations (such as from approximately 5 to 20 g/L chloride) optimum extraction and selectivity is achieved by increasing the ratio of TOPO/tertiary amine with increasing chloride concentration.

Figure 4:
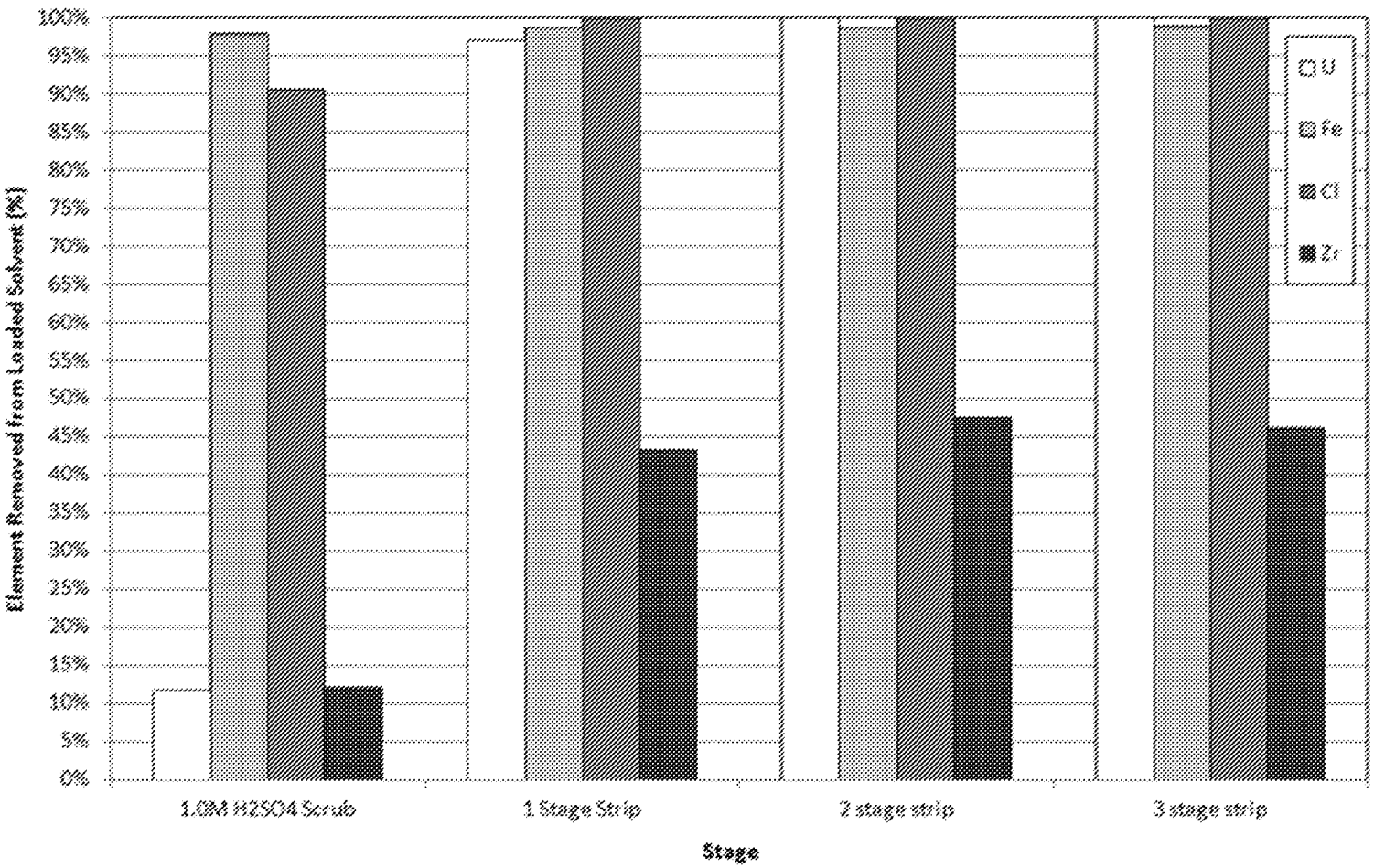
FIG. 4 is a graph illustrating the % removal of elements from a loaded solvent during the scrub and strip stages.

Referring now to FIG. 4, this graph illustrates the percentage of elements removed from the loaded solvent during the subsequent scrub and strip steps. Working from left to right, are the results from the scrub step, and the cumulative results from the three strip stages respectively.

The key for dealing with decreased selectivity relies on effective scrubbing which may be achieved with dilute sulphuric acid in one or more stages. In FIG. 4, the scrub step was conducted using a 1.0M $H_2SO_4$ solution and comprised one stage. In a single contact the iron was reduced by 97.8% and the chloride was reduced by 90.4%. If a second counter current scrubbing stage is introduced (not illustrated) the total separation was found to be 99.9% for the iron and 98.4% for the chloride. A third counter current scrubbing stage separated iron and chloride levels even further, resulting in effectively 100% separation.

Stripping of uranium was accomplished in three stages using a concentrated ammonium sulphate solution (3.5 M $(NH_4)SO_4$) at controlled pH of 2 where the uranium level in the organic was removed to a level below the detectable limit (<1 mg/L) of the employed analytical method. Standard ammonium diuranate (ADU) product was precipitated from the resulting strip liquor by addition of concentrated aqueous ammonia (25 wt %) to increase the strip liquor pH to ~7 at a controlled temperature of 35° C.

Figure 5:
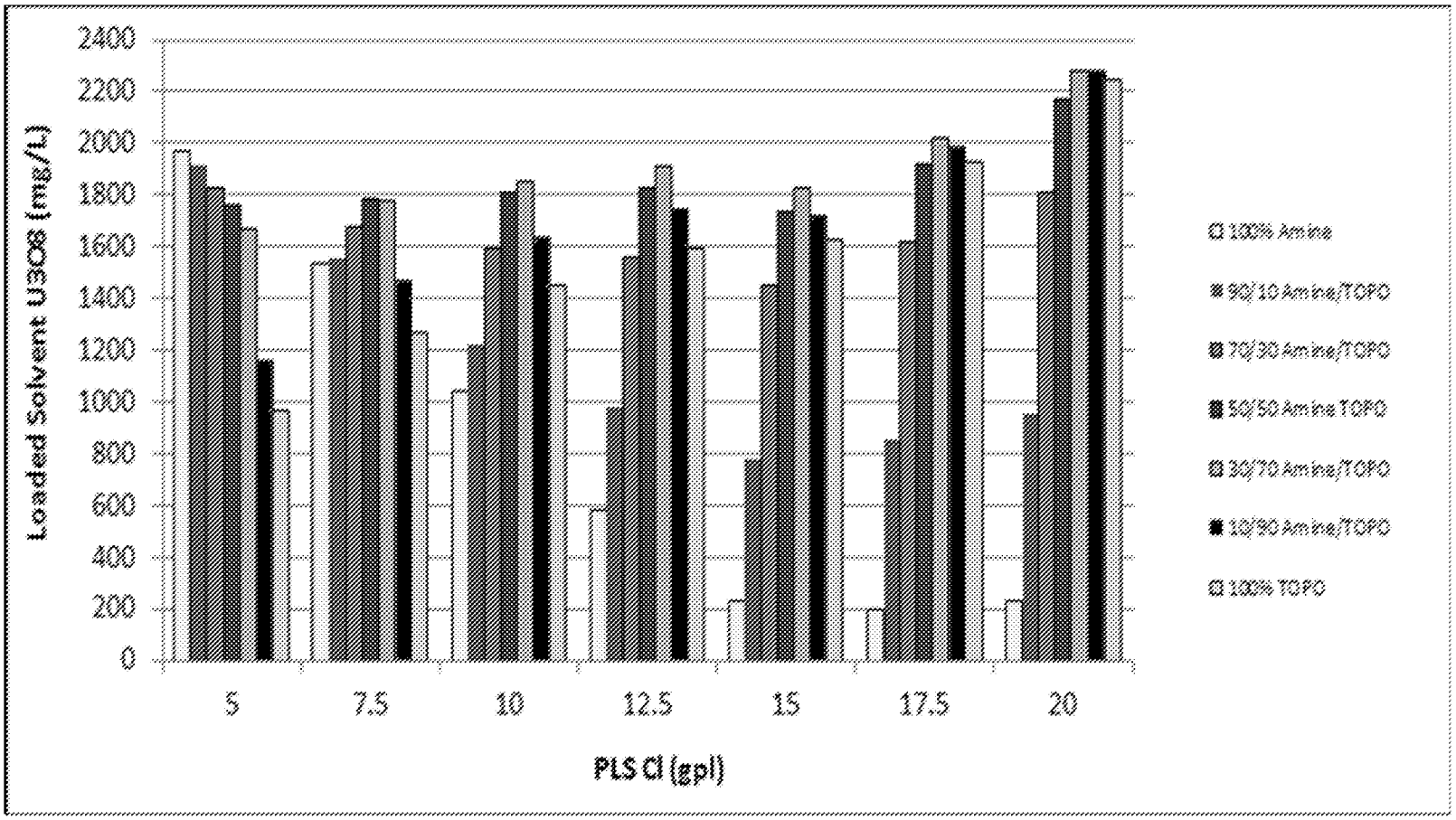
FIG. 5 is a graph showing the extraction of uranium (mg/L) versus chloride concentration (g/L) in the PLS for different ratios of TAPO to tertiary amine.

FIG. 5 demonstrates the various uranium extraction amounts achieved by varying the ratio of tertiary amine to TAPO in the organic phase for different salinities of PLS. For each salinity of 5, 7.5, 10, 12.5, 15, 17.5, and 20 g/L chloride, the ratio of tertiary amine to TOPO was varied from (going left to right) 100% amine to 100% TOPO. The graph suggests that at chloride concentrations of around 5 g/l, uranium extraction is maximised by using 100% tertiary amine in the organic phase. At chloride concentrations above 5 g/l and up to about 20 g/l, good uranium extractions can be achieved with an amine/TAPO ratio of at least 90:10 and preferably at least 70:30. As the chloride concentration in the PLS increases, the optimal amine/TAPO ratio decreases. For chloride concentrations greater than 7.5 g/l, the optimal ratio is 30:70. Above 20 gpl, 100% TAPO (ie, no amine) may be used.

EXAMPLES

Non-limiting Examples of the solvent extraction process will now be described.

Comparative Example 1

Acidic, uranium containing PLS having a chloride concentration of 3.5 g/L was contacted with a solvent comprising 0.13 M Alamine 336 in kerosene. Extraction was conducted over 4 stages at 70% efficiency per stage at an aqueous/organic (A:O) ratio of 8, a solvent loading of 49.7% of the maximum load (typically 40 to 70%) and a temperature of 45° C. The overall uranium extraction was ~97.6%.

Example 1

Acidic, uranium containing PLS having a chloride concentration of 25 g/L was contacted with a blend of 0.1M Alamine 336 and 0.2M TOPO in a kerosene solvent. Extraction was conducted over 4 stages at 70% efficiency per stage at an aqueous/organic (A:O) ratio of 8, a solvent loading of 27.7% of the maximum load and a temperature of 20° C. The overall uranium extraction was ~98%. Accordingly, uranium extraction is approximately the same as in Comparative Example 1 despite the significantly higher chloride level and lower temperature, which ordinarily would be expected to have an adverse effect on reaction kinetics and therefore extent of extraction.

Representative concentrations of the elements extracted in Example 1 are illustrated in FIG. 2 which shows the high levels of co-extracted impurities, mainly iron and chloride.

It is noted that the solvent loading in Example 1 (27.7%) is lower than that of Comparative Example 1 (49.7%). This indicates that the available extraction sites in Example 1 exceeded the quantity of uranium able to be extracted. This suggests that the extractant concentration could be reduced, which would thereby increase the percentage of maximum uranium loading and lower the extraction of impurities while still resulting in acceptable uranium extraction.

The loaded solvent was subsequently subjected to scrubbing with 1.0M $H_2SO_4$ solution. In a single contact the iron was reduced by 97.8% and the chloride was reduced by 90.4%.

Stripping of uranium was accomplished in three consecutive stages using a concentrated ammonium sulphate solution (3.5 M $(NH_4)SO_4$) at controlled pH of 2 where the uranium level in the organic was removed to a level below the detectable limit (<1 mg/L). Standard ammonium diuranate (ADU) product was then precipitated from the resulting strip liquor by addition of concentrated aqueous ammonia (25 wt %) to increase the strip liquor pH to ~7 at a controlled temperature of 35° C.

Example 2

Acidic, uranium containing PLS having a chloride concentration of 25 g/L was contacted with 0.2M TOPO in a kerosene solvent. Extraction was conducted over 4 stages at 70% efficiency per stage at an aqueous/organic (A:O) ratio of 8, a solvent loading of 29.6% of the maximum load and a temperature of 20° C. The overall uranium extraction was ~97.6%. Again, uranium extraction is approximately the same as in Comparative Example 1 despite the significantly higher chloride level and lower temperature.

Representative concentrations of the elements extracted in Example 2 are illustrated in FIGS. 2 and 3 which show the high levels of co-extracted impurities, mainly iron and chloride. However, the quantities of coextracted iron and chloride were significantly lower at the particular chloride concentration when the solvent comprised TOPO alone.

Again, compared to Comparative Example 1, the lower solvent loading of this Example indicates that the extractant concentration could be reduced. This would lower the extraction of impurities and still result in acceptable uranium extraction.

The loaded solvent was subsequently subjected to scrubbing with 1.0M $H_2SO_4$ solution. In a single contact the iron was reduced by 97.8% and the chloride was reduced by 90.4%.

Stripping of uranium was accomplished in three consecutive stages using a concentrated ammonium sulphate solution (3.5 M $(NH_4)SO_4$) at controlled pH of 2 where the uranium level in the organic was removed to a level below the detectable limit (<1 mg/L). Standard ammonium diuranate (ADU) product was then precipitated from the resulting strip liquor by addition of concentrated aqueous ammonia (25 wt %) to increase the strip liquor pH to ~7 at a controlled temperature of 35° C.

Advantages of the disclosed solvent extraction process include:

The process enables exceptional uranium recovery levels from a high salinity PLS, particularly one containing both high levels of chloride and iron. The process is able to not only successfully extract uranium from ore or ore concentrate, but can also effectively recover the extracted uranium from the solvent in order to produce a final product. To date, such a process has not existed in either solvent extraction or ion exchange technologies.

The process potentially enables the processing of PLS having substantial variation in composition (particularly salinity) with minimal variation in the physical process units and resultant flow sheet.

The process may also be successfully operated over a reasonable temperature range.

Whilst a number of process embodiments have been described, it should be appreciated that the process may be embodied in many other forms.

In the claims which follow, and in the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein.

The invention claimed is:

1. A process for extracting uranium from saline acidic uranium, chloride, iron (III) and sulphate containing solution having >5 g/L chloride, comprising:

a. contacting the solution with an organic phase containing a trialkylphosphine oxide (TAPO) as an extractant to form a uranium loaded organic phase;

b. scrubbing the uranium loaded organic phase with a scrubbing solution comprising a sulphuric acid based aqueous solution to remove any impurities and to form a scrubbed organic phase;

c. stripping uranium from the scrubbed organic phase with a concentrated sulphate solution having a sulphate concentration greater than IM to produce an aqueous uranium strip solution; and d. precipitating a uranium product from the aqueous uranium strip solution.

2. The process of claim 1 wherein the trialkylphosphine oxide is a trioctylphosphine oxide.

3. The process of claim 1 wherein the organic phase includes a blend of at least two trialkylphosphine oxides.

4. The process of claim 1 wherein the organic phase additionally includes a substituted amine or its salt.

5. The process of claim 4 wherein the ratio of trialkylphosphine oxide to substituted amine or its salt is varied according to the level of impurities in the acidic uranium and chloride containing solution.

6. The process of claim 4 wherein the ratio of trialkylphosphine oxide to substituted amine or its salt is varied according to the salinity of the acidic uranium and chloride containing solution.

7. The process of claim 4 wherein at chloride concentrations above 5 g/l, the molar ratio of substituted amine or its salt to TAPO in the organic phase is a minimum of 90:10.

8. The process of claim 4 wherein at chloride concentrations above 10 g/l, the ratio of substituted amine or its salt to TAPO in the organic phase is at least 50:50.

9. The process of claim 1 wherein at chloride concentrations above 20 g/l, the organic phase contains no substituted amine or its salt.

10. The process of claim 1, where the sulfuric acid based aqueous solution has an acid concentration from 0.1 M-1.0 M.

11. The process of claim 1 wherein the scrubbed organic is stripped using an ammonium sulfate solution.

12. The process of claim 11, wherein the ammonium sulfate is solution has a concentration of up to saturation.

13. The process of claim 1 wherein the scrubbed organic is stripped using a sodium sulfate solution.

14. The process of claim 1 wherein the process is conducted at a temperature up to 50° C.

15. The process of claim 1 wherein the uranium product is an ammonium diuranate (ADU).

16. The process of claim 1 wherein the process is operated continuously.

17. A process for extracting uranium from an acidic saline uranium and iron (III) solution having >5 g/L chloride, comprising:

a. contacting the solution with an organic phase containing a trialkylphosphine oxide as an extractant to form a uranium loaded organic phase;

b. scrubbing the uranium loaded organic phase with a scrubbing solution comprising a sulphuric acid based aqueous solution to remove any impurities and to form a scrubbed organic phase;

c. stripping uranium from the scrubbed organic phase with a concentrated sulphate solution to produce an aqueous uranium strip solution; and d. precipitating a uranium product from the aqueous uranium strip solution.

18. A process for extracting uranium from an acidic saline uranium and iron (III) containing solution comprising contacting the solution with an organic phase containing a trialkylphosphine oxide (TAPO) and a substituted amine or its salt as extractants, wherein the organic phase has a ratio of the TAPO to the substituted amine or substituted amine salt which is determined by the chloride concentration in the saline uranium containing solution.

* * * * *